US011198552B2

(12) United States Patent
Gronikowski, III et al.

(10) Patent No.: US 11,198,552 B2
(45) Date of Patent: Dec. 14, 2021

(54) FLEXIBLE INSULATED BEVERAGE HOLDER WITH RIGID PLATE AND HANDLE

(71) Applicants: Wesley Gronikowski, III, Middleburg, FL (US); Wesley Gronikowski, IV, Middleburg, FL (US)

(72) Inventors: Wesley Gronikowski, III, Middleburg, FL (US); Wesley Gronikowski, IV, Middleburg, FL (US)

( * ) Notice: Subject to any disclaimer, the term of this patent is extended or adjusted under 35 U.S.C. 154(b) by 0 days.

(21) Appl. No.: 16/198,110

(22) Filed: Nov. 21, 2018

(65) Prior Publication Data

US 2020/0324960 A1 Oct. 15, 2020

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01); *A47G 2023/0291* (2013.01)

(58) Field of Classification Search
CPC ..... B65D 81/3876; A47G 23/0216; A47G 2023/0291
USPC ..... 220/739
See application file for complete search history.

(56) References Cited

U.S. PATENT DOCUMENTS

| | | | | |
|---|---|---|---|---|
| 4,383,422 | A | 5/1983 | Gordon | |
| 4,966,303 | A | 10/1990 | Jones | |
| 5,147,067 | A | 9/1992 | Effertz | |
| 6,685,047 | B1 | 2/2004 | Mott | |
| 10,548,424 | B1 * | 2/2020 | Ahlstrom | A47G 23/0216 |
| 2002/0185496 | A1 * | 12/2002 | Puerini | A47G 23/0216 220/738 |
| 2011/0127283 | A1 * | 6/2011 | Delucia | A45F 5/02 220/739 |
| 2012/0228318 | A1 * | 9/2012 | Martin | A47G 23/0216 220/739 |
| 2013/0200087 | A1 * | 8/2013 | Mango | A47G 23/0216 220/710.5 |
| 2014/0131372 | A1 * | 5/2014 | Hiner | B65D 81/3876 220/739 |

* cited by examiner

*Primary Examiner* — Shawn M Braden
(74) *Attorney, Agent, or Firm* — Law Office of Mitchell Ghaneie, P.A.; Mitchell Ghaneie; Christopher Roberts

(57) ABSTRACT

This device is a flexible insulated beverage holder with a rigid arcuate plate and a rigid handle attached. This device allows a user to hold only the handle and insert a beverage container into the insulated beverage holder. This is achievable because the attached plate forces the insulated beverage holder to provide an expanded opening at its top. As the beverage is inserted into the opening created by the plate the user need only grip the handle as the beverage container is pushed to the bottom of the insulated beverage holder. This device provides the benefits of grasping a sturdy handle, while also providing significant portability with the flexible insulated beverage holder.

12 Claims, 12 Drawing Sheets

FLEXIBLE INSULATED BEVERAGE HOLDER WITH RIGID PLATE AND HANDLE

BACKGROUND OF THE INVENTION

A. Field of the Invention

This invention relates to a flexible beverage holder that assists with insulating the contents within a can, cup or bottle.

B. Prior Art

Typically, insulated beverage holders provide a flexible material that the beverage is placed within that does not provide a handle. Alternatively, other insulated beverage holders provide a semi-rigid insulated material that the beverage is placed within. The semi-rigid beverage holder will in some instances provide a rigid handle that is integrated into the beverage holder.

The issue with the prior art is that the flexible beverage holder requires one hand to open the beverage holder so that the beverage can be inserted. While the alternative rigid insulated beverage holder does not require manual opening prior to inserting a beverage, the rigid holder is not collapsible for placement within a user's pocket. The device described and claimed herein allows for collapsing and easily allows for a user to place a beverage into the beverage holder without requiring the user to first open the beverage.

BRIEF SUMMARY OF THE INVENTION

The present invention is a device which is comprised of a flexible insulation material that is attached to a plate with arcuate surface that provides an integrated handle. When the arcuate surface of the plate is attached to the insulated beverage holder, it causes the insulated beverage holder to open, thereby not requiring the user to hold the insulated beverage holder in an open or expanded position. Thus, a user can easily insert her or his desired beverage into the insulated beverage holder while merely holding the handle integrated into the plate.

Once the beverage is inserted the user may use the device to assist with drinking the beverage or may use the device to pour a beverage. For larger containers such as a two-liter bottle, this can be quite useful for safely pouring the contents of the bottle into a cup and insulating the contents of the bottle while it is sitting. For smaller beverages, this device is helpful with safely holding a beverage while drinking and quickly exchanging beverages because the plate causes the insulated beverage holder to maintain an opening at its top.

As an alternative embodiment, the arcuate plate with handle may slide into a track that is adhered to the flexible insulated beverage holder. In turn, the plate with handle may be removed from and attached to the insulated beverage holder as desired by the user.

NUMBERING REFERENCE

Figure 1:
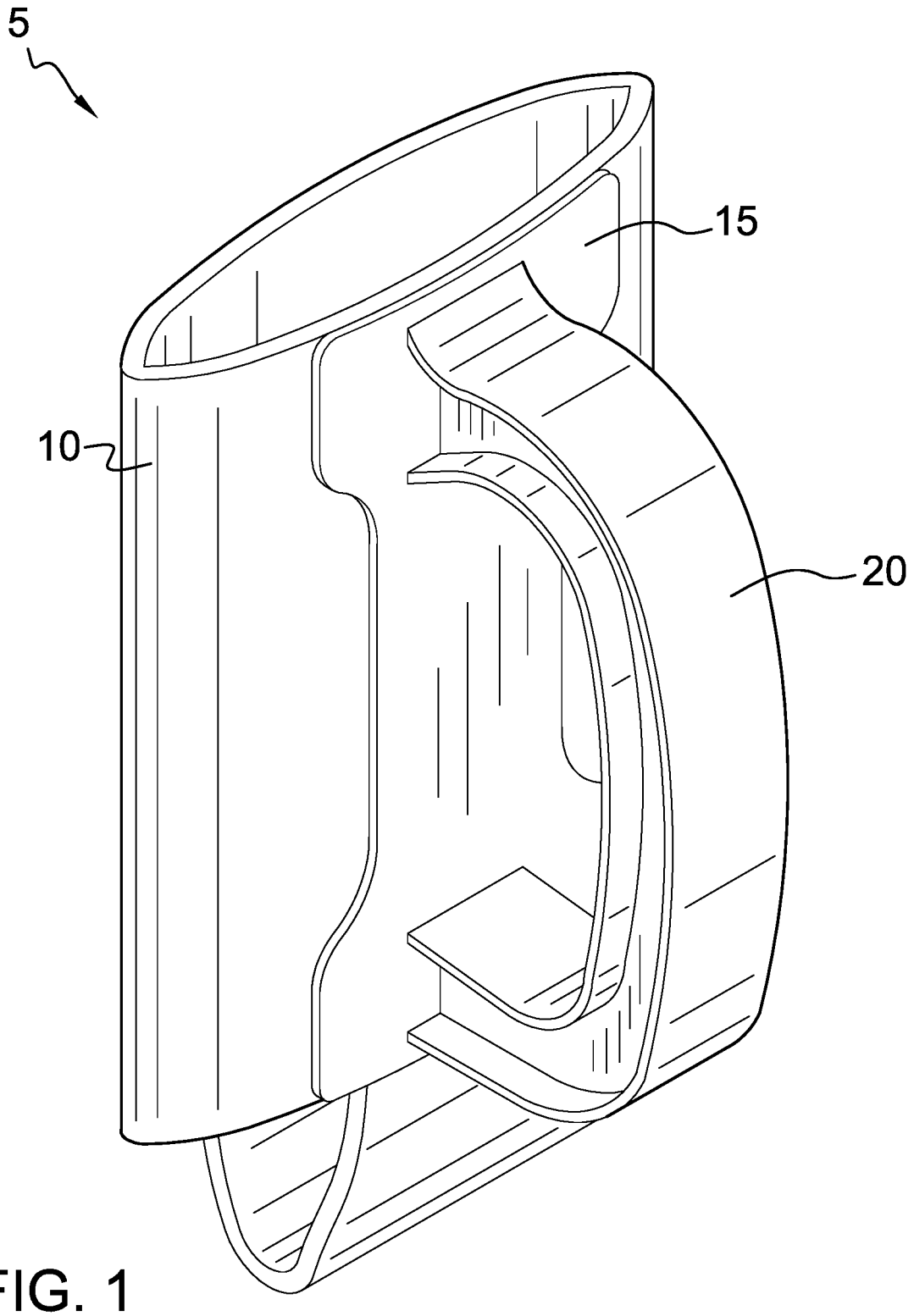
FIG. 1 is a front isometric view of the first embodiment showing the insulated beverage holder in a substantially relaxed state.

5—First embodiment
10—Insulated beverage holder
15—Plate
20—Handle
50—Second embodiment
60—Track
**60*a***—First side of track
**60*b***—Second side of track

DETAILED DESCRIPTION OF THE EMBODIMENTS

This device is a flexible insulated beverage holder 10 that is attached to a rigid plate 15 and handle 20, which is described below in two separate embodiments: a first embodiment 5 and a second embodiment 50.

First Embodiment

Figure 2:
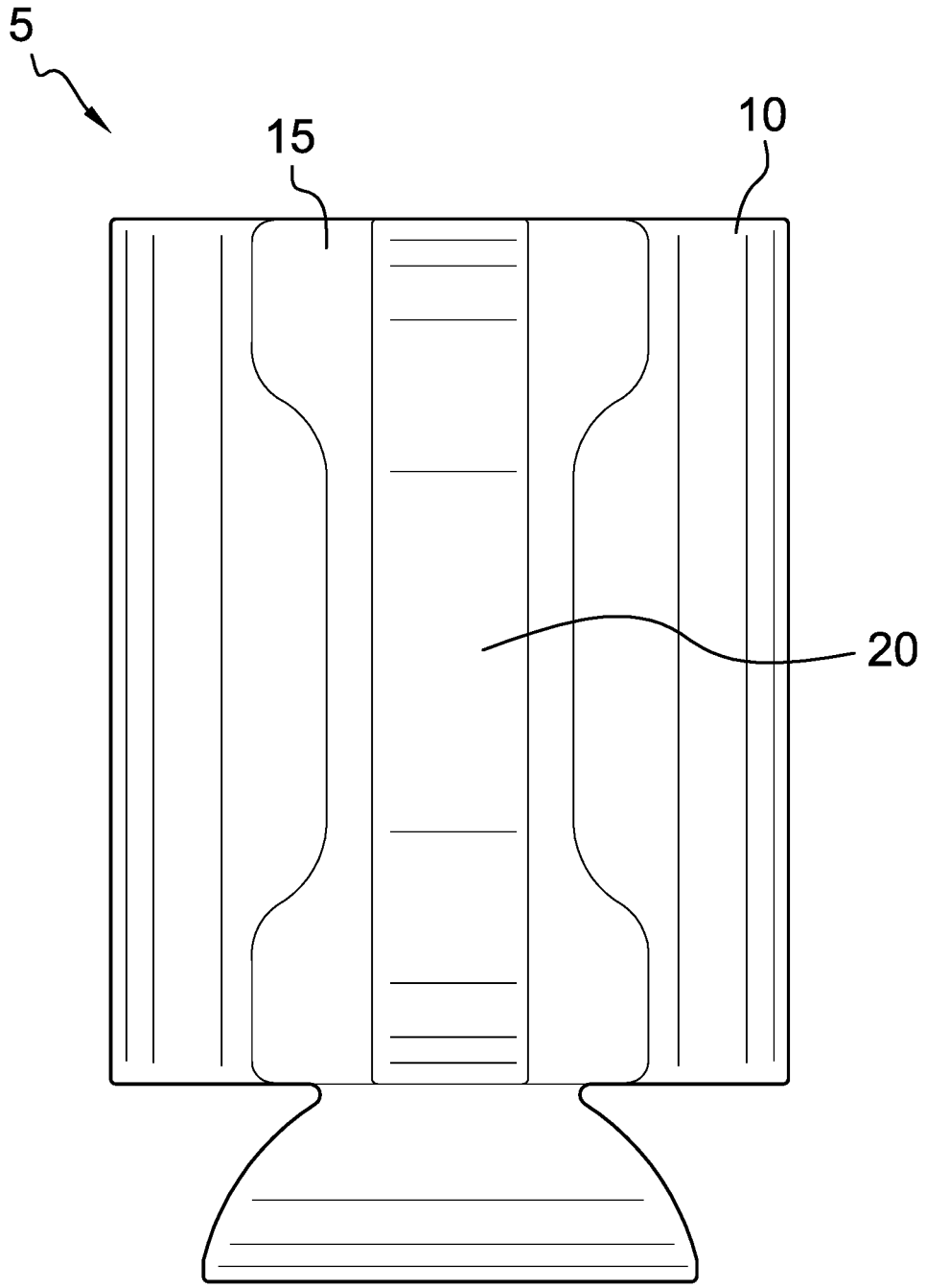
FIG. 2 is a front view of the first embodiment showing the insulated beverage holder in a substantially relaxed state.
Figure 3:
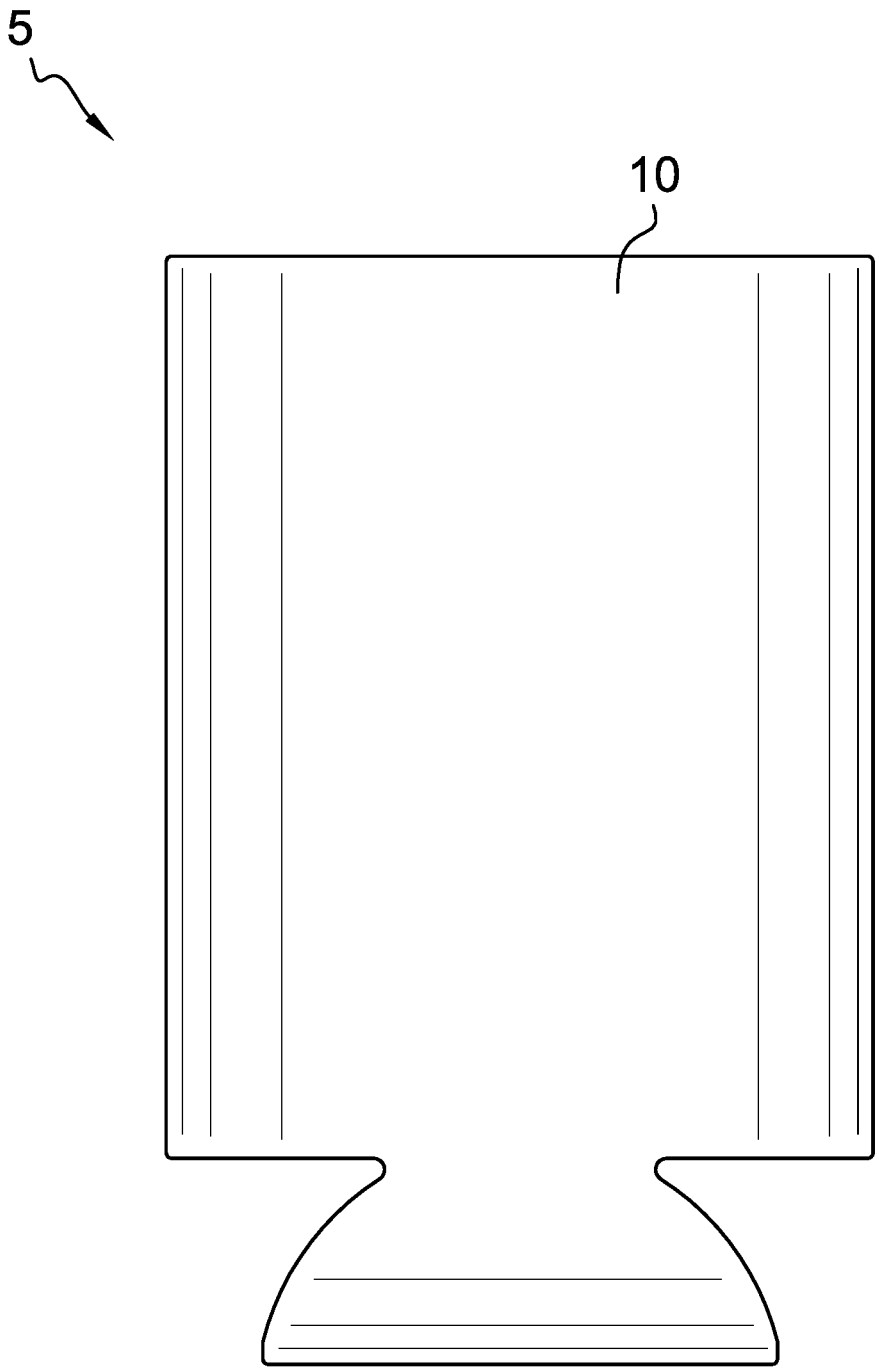
FIG. 3 is back view of the first embodiment showing the insulated beverage holder in a substantially relaxed state.
Figure 4:
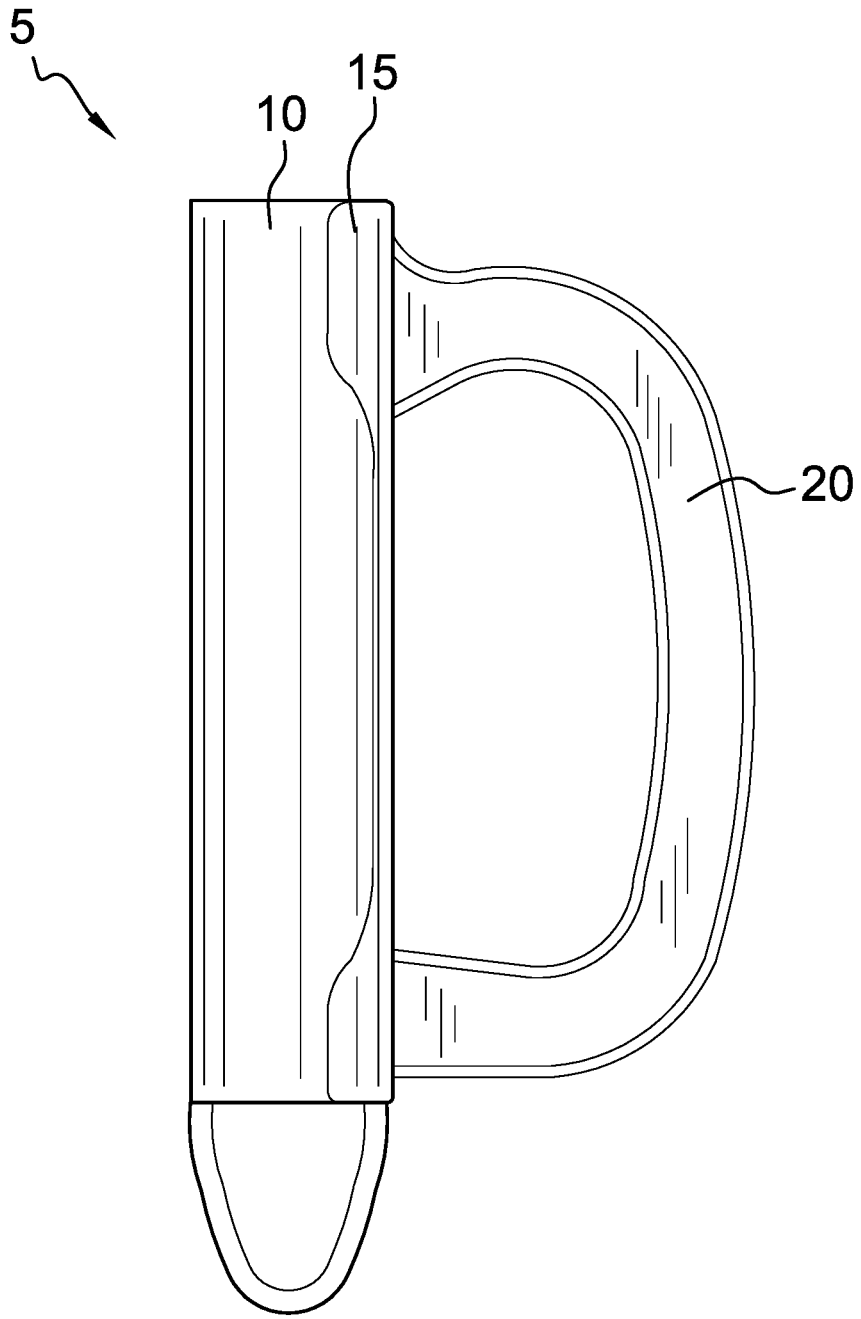
FIG. 4 is side view of the first embodiment showing the insulated beverage holder in a substantially relaxed state.

In this first embodiment 5 the device is comprised of a flexible insulated beverage holder 10, a rigid plate 15, and a handle 20. The rigid plate 15 provides two sides with each side having an arcuate surface. The arcuate surface of one side of the plate 15 is adhered to the insulated beverage holder 10, while the other side is integrated with the handle 20, which is shown in FIG. 1. In addition to the plate 15 providing an arcuate surface, the plate 15 is substantially the same height as the insulated beverage holder, which is shown in FIG. 2. However, it is anticipated that the plate is smaller in height than the insulated beverage holder.

Figure 5:
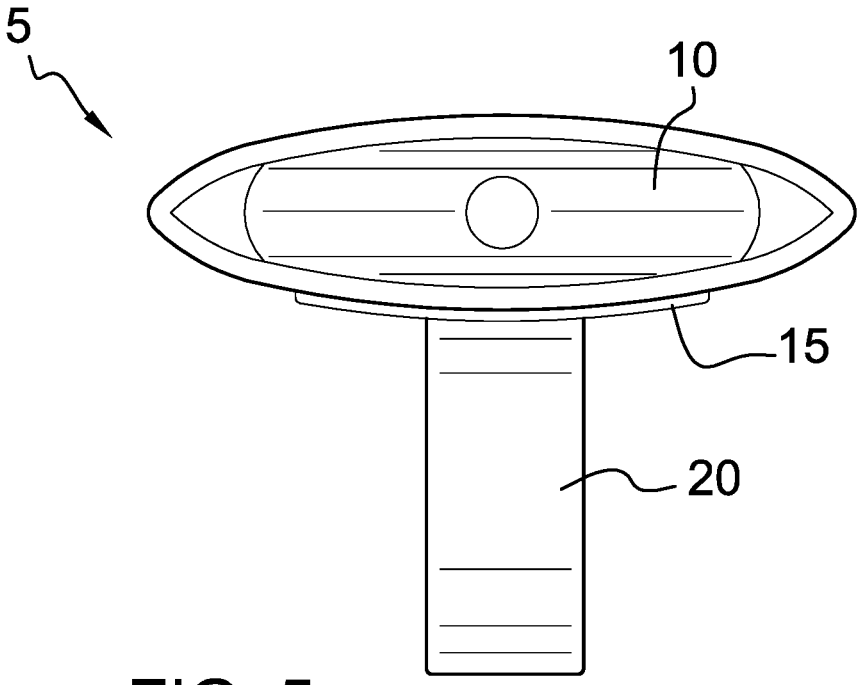
FIG. 5 is a top view of the first embodiment showing the insulated beverage holder in a substantially relaxed state.
Figure 6:
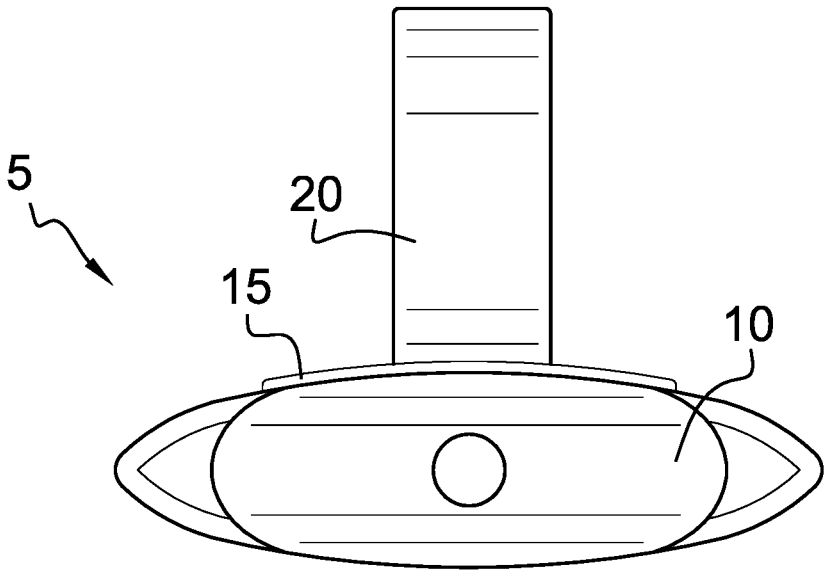
FIG. 6 is a bottom view of the first embodiment showing the insulated beverage holder in a substantially relaxed state.
Figure 7:
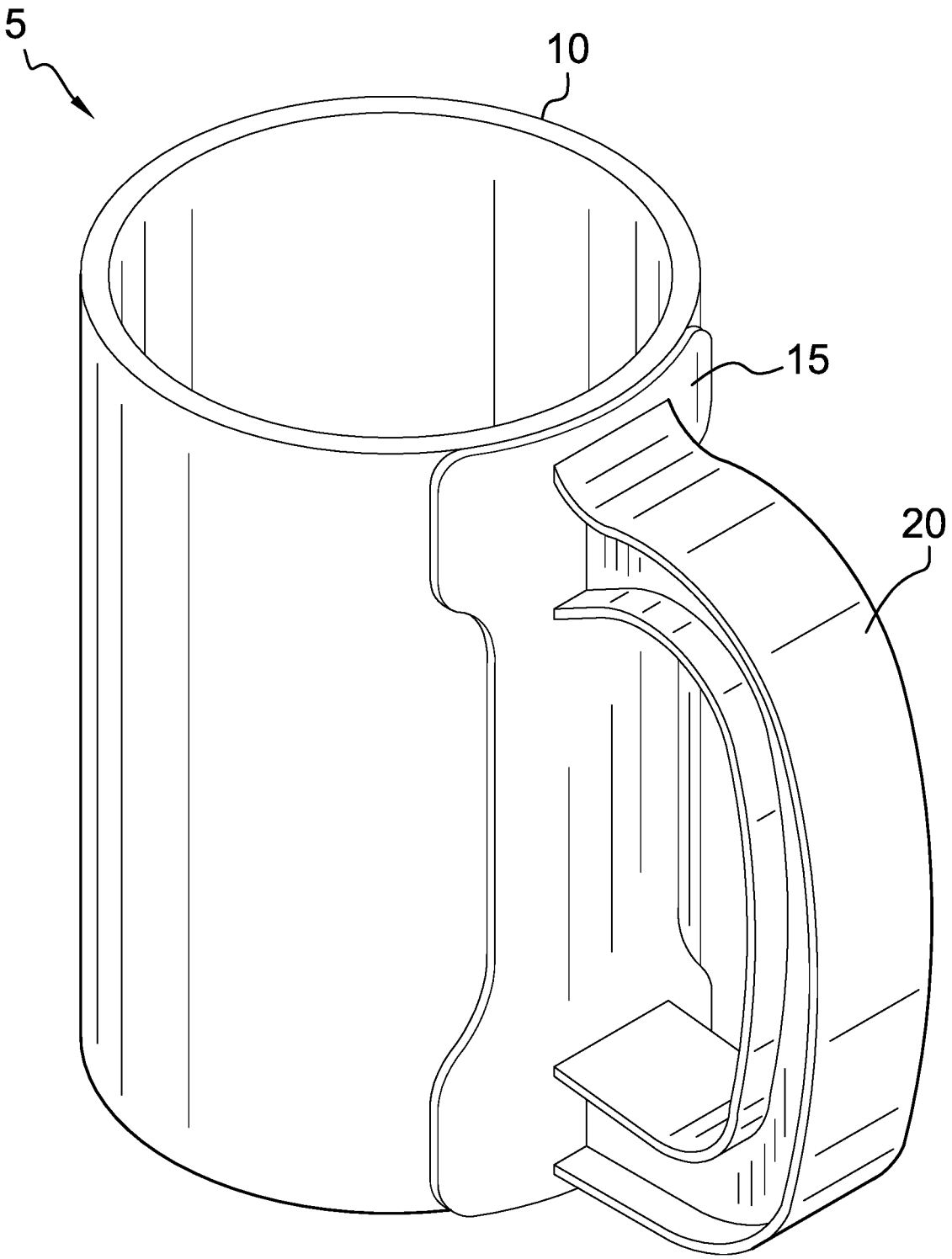
FIG. 7 is a front isometric view of the first embodiment showing the insulated beverage holder in a substantially expanded state.
Figure 8:
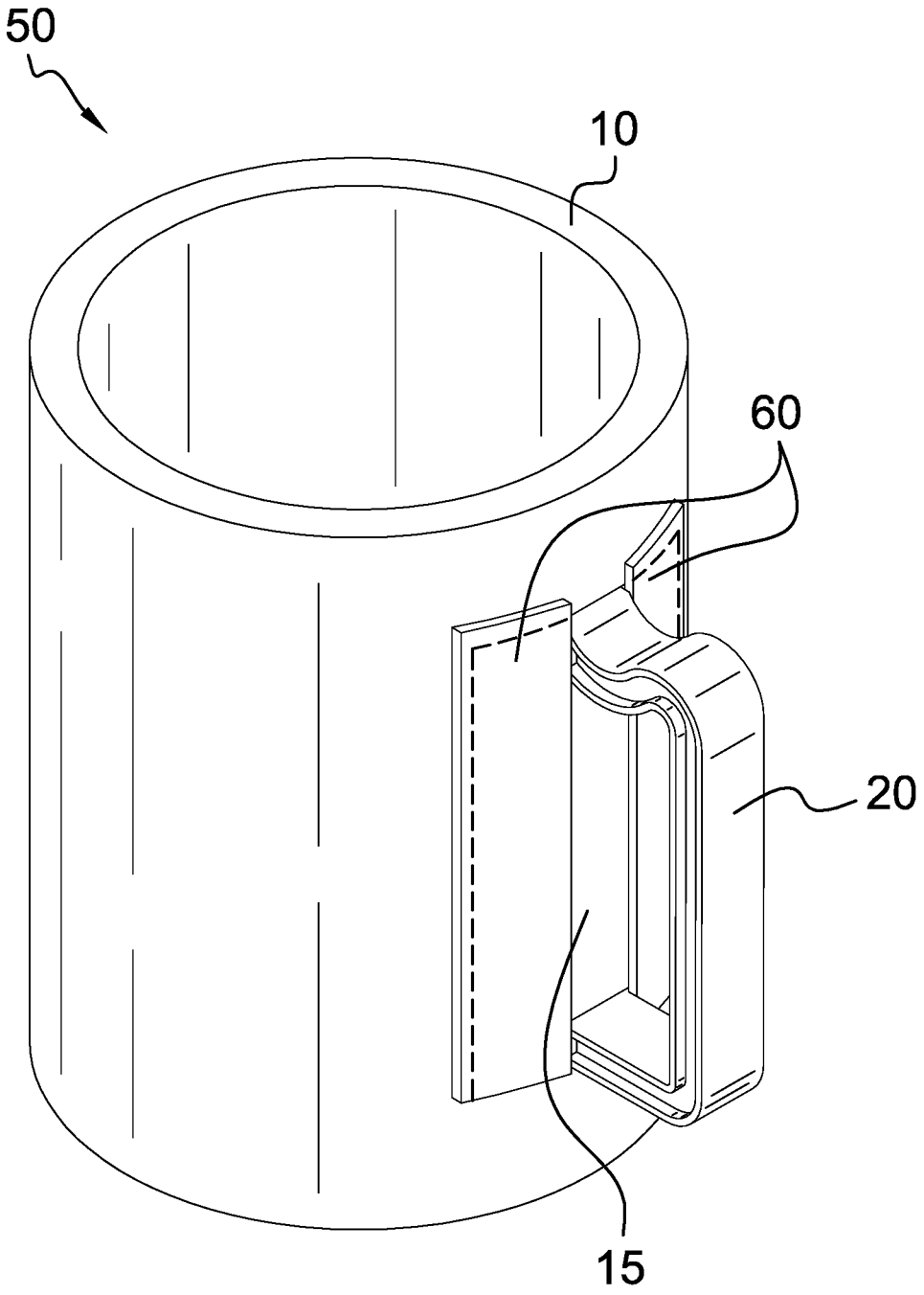
FIG. 8 is a front isometric view of the second embodiment showing the insulated beverage holder in a substantially expanded state.
Figure 9:
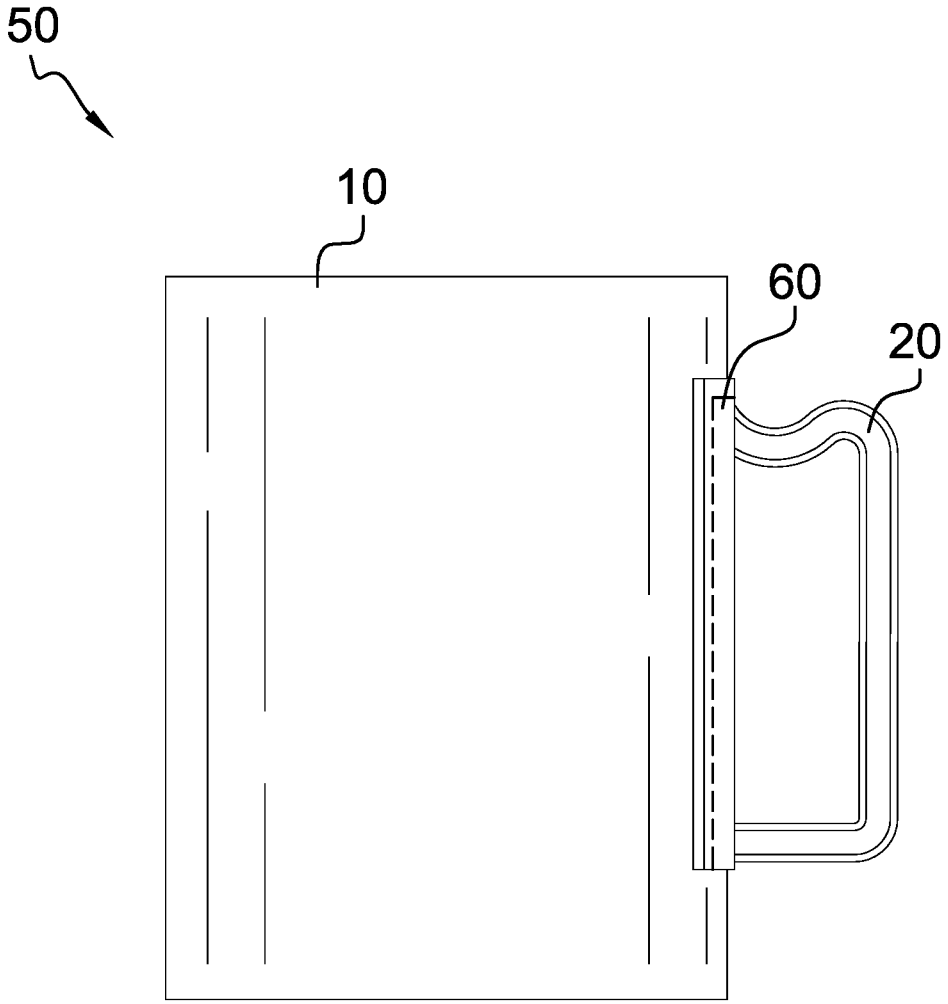
FIG. 9 is a side view of second embodiment showing the insulated beverage holder in a substantially expanded state.
Figure 10:
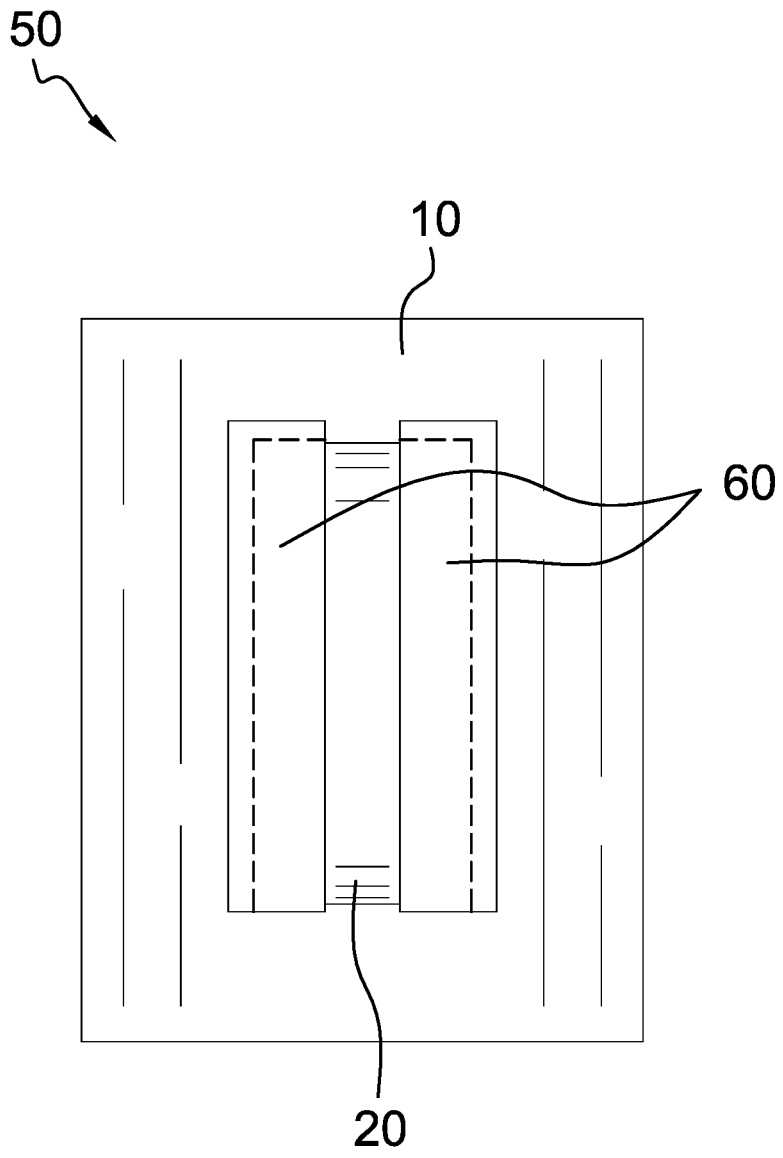
FIG. 10 is a front view of the second embodiment showing the insulated beverage holder in a substantially expanded state.
Figure 11:
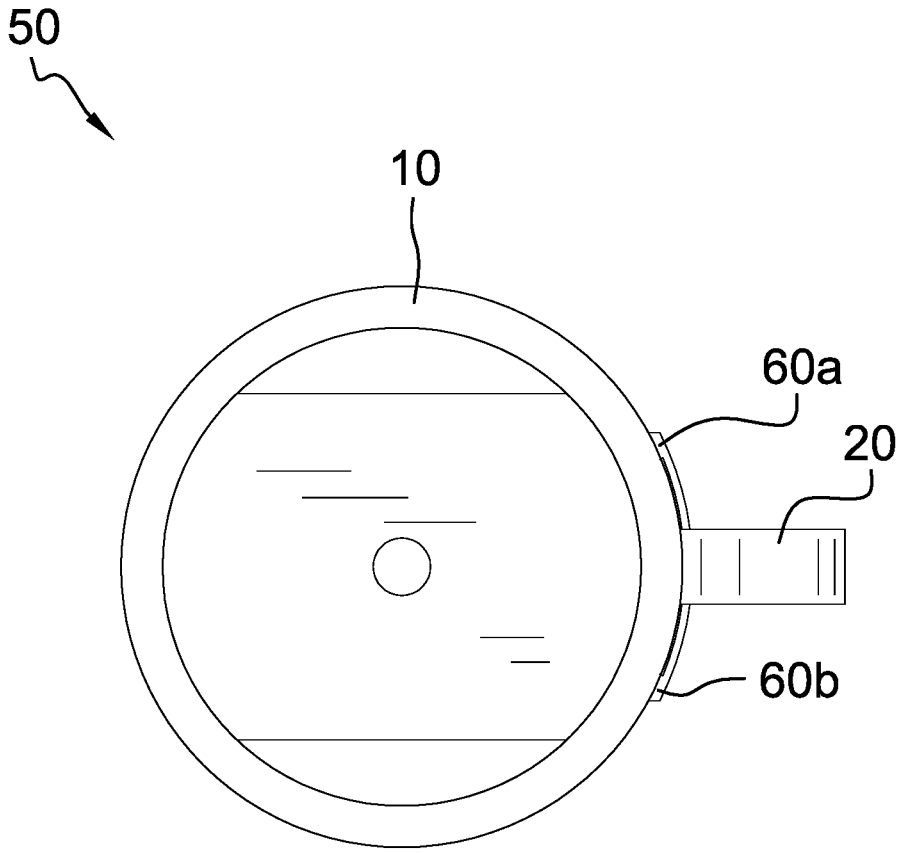
FIG. 11 is a bottom view of the second embodiment showing the insulated beverage holder in a substantially expanded state.
Figure 12:
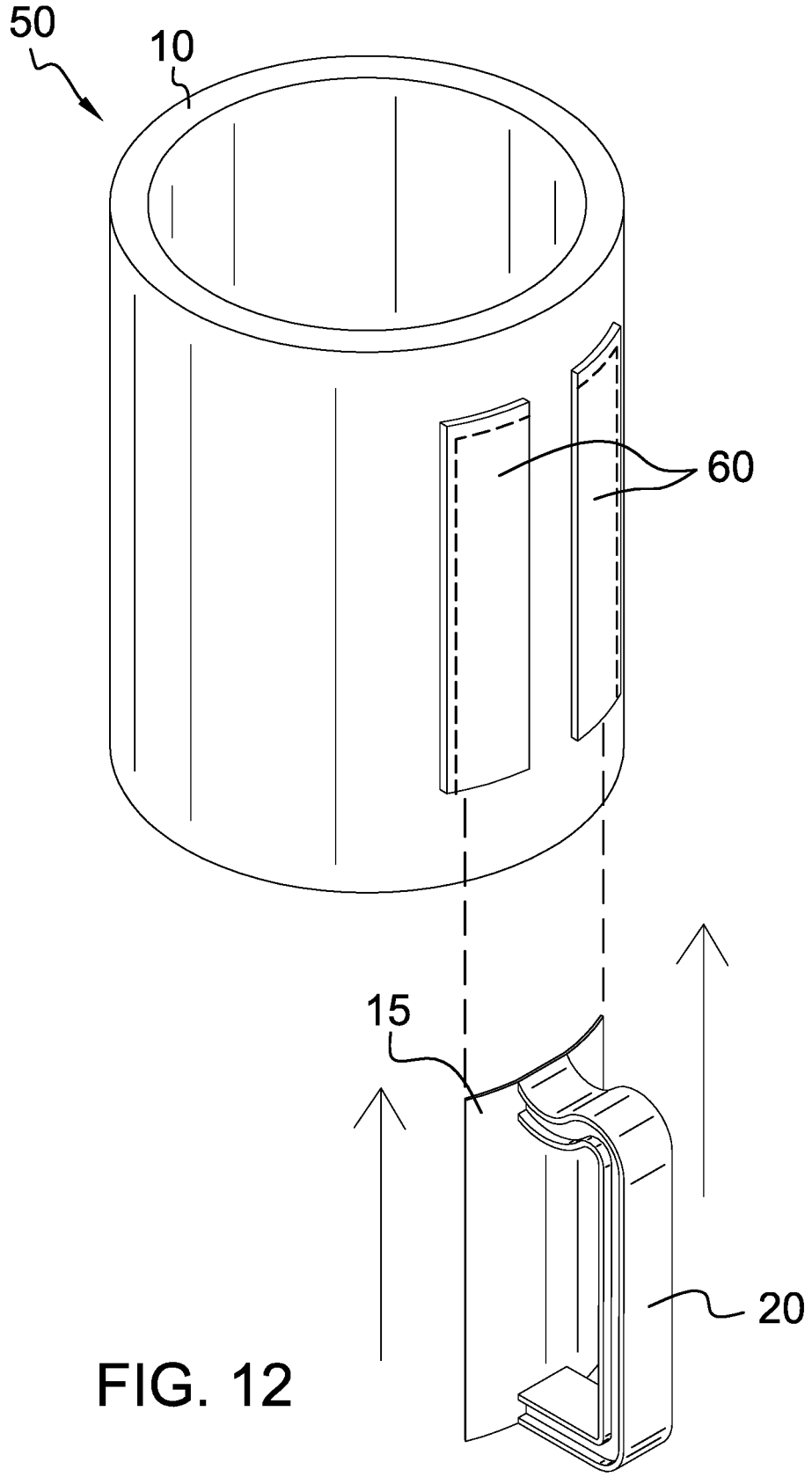
FIG. 12 is an isometric view of the second embodiment showing the handle and plate detaching from the track.
Figure 13:
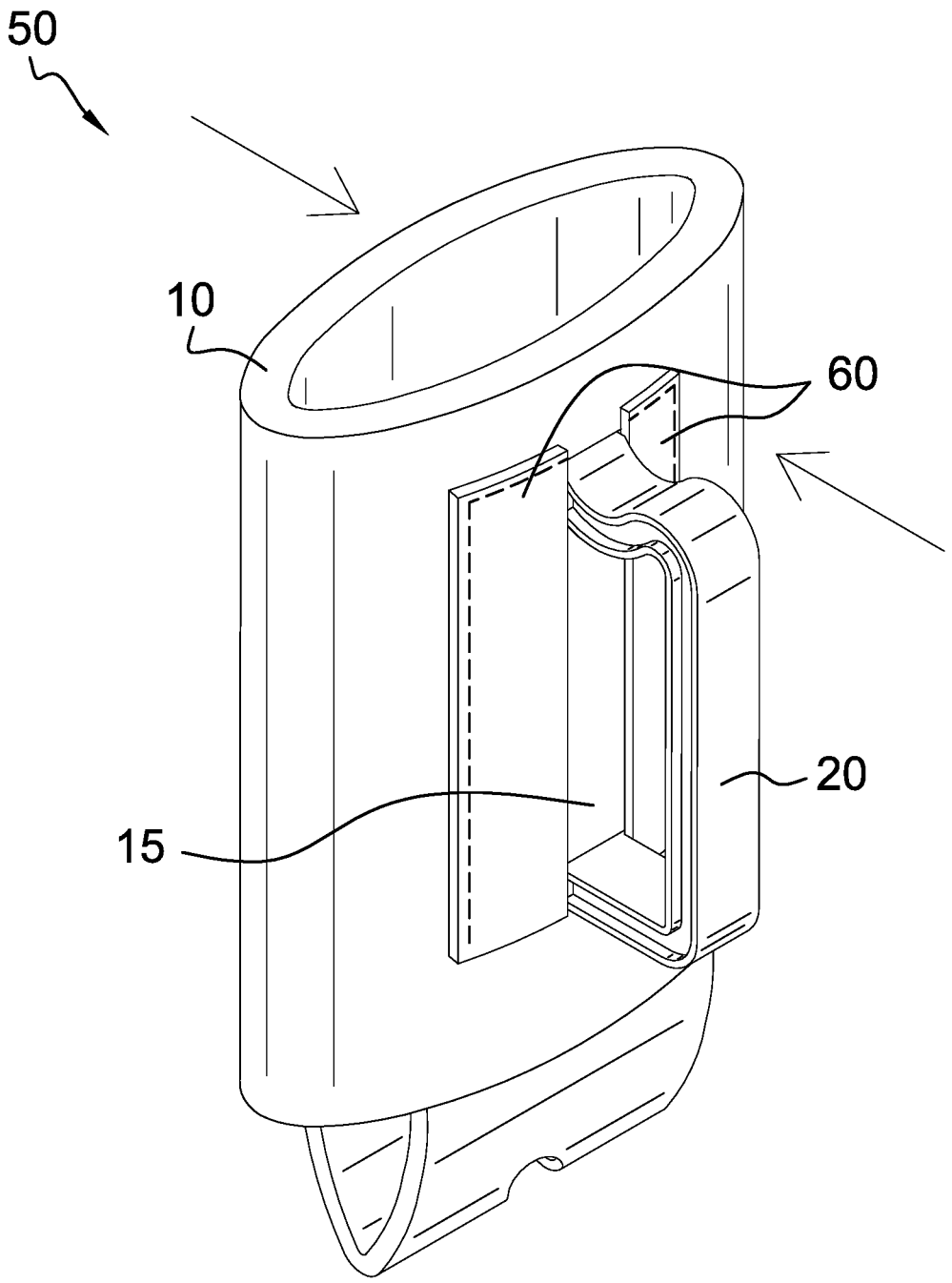
FIG. 13 is an isometric view of the second embodiment showing the insulated beverage holder in a substantially collapsed state.

The arcuate shape of the plate 15, as shown in FIG. 5 and FIG. 6, forces the top of the material of the insulated beverage holder 10 to form to the shape of the arcuate surface when the plate 15 is attached to the insulated beverage holder 10. Thus, the plate 15 forces the insulated beverage holder 10 to provide an opening at its top while the insulated beverage holder 10 is in a relaxed position. Consequently, a user need only hold the handle 20 while inserting or removing a can, cup, or bottle. Accordingly, the user can easily insert the drink without making direct contact with the insulated beverage holder 10.

In addition to allowing a user to easily and quickly insert or remove a beverage from the insulated beverage holder 10, the handle increases a user's ability to maintain the drink, as well allowing a user to use one finger around the handle 20 to carry a beverage within the device. Also, the rigid handle 20 and plate 15 assist with pouring a drink beverage when needed. For example, if the beverage container is a two liter bottle. The rigid plate 15 assists with stabilizing the bottle within the insulated beverage holder 10 and the handle 20 assists the user with pouring.

Furthermore, this device provides significant portability because the insulated beverage holder 10 is flexible. Therefore, a user is capable of collapsing the insulated beverage holder 10 and placing it in a pocket or other small compartment.

Second Embodiment

This second embodiment 50 is comprised of an insulated beverage holder 10, a rigid arcuate plate 15, a handle 20, and a track 60. The track is further comprised of a first part 60*a* and a second part 60*b*. The first part 60*a* and second part 60*b* each provide a top, a bottom, a front side, a back side, a first side, and a second side. The tops and the first sides of the first part 60*a* and second part 60*b* are attached to the insulated beverage holder 10. The bottoms and second sides of the first part 60*a* and second part 60*b* lay over the insulated beverage holder 10 but are not attached to the insulated beverage holder 10. In turn, the track 60 allows the plate 15 to slide, or otherwise be placed, between the insulated beverage holder and the bottom side of the first part 60*a* and the bottom side of the second part 60*b*. The handle 20 is slid, or otherwise placed, between the second side of the first part 60*a* and the second side of the second part 60*b*.

The plate 15 with integrated handle 20 can therefore, be removed from the track 60 or inserted into the track 60 as the user desires. When the arcuate plate 15 and handle 20 are inserted into the track 60, the arcuate surface of the plate 15 forces the material of the insulated beverage container 10 to form into the arcuate surface of the plate 15. Therefore, the opening of the insulated beverage holder 10 will be forced into an open position while the plate 15 is placed within the track 60. It is anticipated that the handle 20 may incorporate an integrated bottle opener.

While the embodiments of the invention have been disclosed, certain modifications may be made by those skilled in the art to modify the invention without departing from the spirit of the invention.

The inventor claims:

1. A device, which is comprised of:
- a. an insulated beverage holder;
  - wherein the insulated beverage holder has a top;
  - wherein the top provides an opening;
  - wherein the insulated beverage holder has a bottom;
  - wherein the insulated beverage holder has an exterior side;
  - wherein the insulated beverage holder has an interior side;
  - wherein the insulated beverage holder is flexible;
- b. a plate;
  - wherein the plate is rigid;
  - wherein the plate provides an arcuate surface;
- c. a track;
  - wherein the track is attached to the exterior of side of the insulated beverage holder;
  - wherein the arcuate surface of the plate is attached to the insulated beverage holder by being placed within the track;
  - wherein the insulated beverage holder forms to the shape of the arcuate surface of the plate while the plate is attached;
  - wherein the attached arcuate surface expands the opening of the top of the insulated beverage holder.

2. The device as described in claim 1, wherein a handle is attached to the plate.

3. The device as described in claim 2, wherein the handle is integrated into the plate.

4. The device as described in claim 1, wherein the track is attached to the insulated beverage holder with adhesive.

5. The device as described in claim 1, wherein the track is attached to the insulated beverage holder with stitching.

6. A device, which is comprised of:
- a. an insulated beverage holder;
  - wherein the insulated beverage holder has a top;
  - wherein the top provides an opening;
  - wherein the insulated beverage holder has a bottom;
  - wherein the insulated beverage holder has an exterior side;
  - wherein the insulated beverage holder has an interior side;
  - wherein the insulated beverage holder is flexible;
- b. a plate;
  - wherein the plate is rigid;
  - wherein the plate provides an arcuate surface;
- c. a handle;
  - wherein the handle is attached to the plate,
- d. a track;
  - wherein the track is attached to the exterior of side of the insulated beverage holder:
  - wherein the arcuate surface of the plate is attached to the insulated beverage holder by being placed within the track:
  - wherein the insulated beverage holder forms to the shape of the arcuate surface of the plate while the plate is attached;
  - wherein the attached arcuate surface expands the opening of the top of the insulated beverage holder.

7. The device as described in claim 6, wherein the handle is integrated into the plate.

8. The device as described in claim 6, wherein the track is attached to the insulated beverage holder with adhesive.

9. The device as described in claim 6 wherein the track is attached to the insulated beverage holder with stitching.

10. A device, which is comprised of:
- a. an insulated beverage holder;
  - wherein the insulated beverage holder has a top;
  - wherein the top provides an opening;
  - wherein the insulated beverage holder has a bottom;
  - wherein the insulated beverage holder has an exterior side;
  - wherein the insulated beverage holder has an interior side;
  - wherein the insulated beverage holder is flexible;
- b. a plate;
  - wherein the plate is rigid;
  - wherein the plate provides an arcuate surface;
  - wherein the plate is attached to the insulated beverage holder;

wherein the insulated beverage holder forms to the shape of the arcuate surface of the plate while the plate is attached;

wherein the attached arcuate surface expands the opening of the top of the insulated beverage holder;

c. a handle;

wherein the handle is attached to the plate, d. a track;

wherein the track is further comprised of a first part and a second part;

wherein the first part provides a top, a bottom, a first side, a second side, a front side and a back side;

wherein the second part provides a top, a bottom, a first side, a second side, a front side, and a back side;

wherein the top and first side of the first part are attached to the insulated beverage holder;

wherein the top and first side of the second part are attached to the insulated beverage holder;

wherein the arcuate surface of the plate is placed between the back side and the exterior side of the insulated beverage holder;

wherein the handle is placed between the second side of the first part and the second side of the second part.

11. The device as described in claim 10 wherein the first part and second part of the track are attached with adhesive.

12. The device as described in in claim 10 wherein the first part and second part of the track are attached with stitching.

* * * * *